US007278478B2

(12) United States Patent
LaClare et al.

(10) Patent No.: US 7,278,478 B2
(45) Date of Patent: Oct. 9, 2007

(54) TUBING STRING ANCHORING TOOL

(76) Inventors: G. Maurice LaClare, Box 245, Edam, Saskatchewan (CA) S0M 0V0; Michael Kobes, Box 34, Edam, Saskatchewan (CA) S0M 0V0

( * ) Notice: Subject to any disclaimer, the term of this patent is extended or adjusted under 35 U.S.C. 154(b) by 272 days.

(21) Appl. No.: 11/115,144

(22) Filed: Apr. 27, 2005

(65) Prior Publication Data

US 2005/0241836 A1 Nov. 3, 2005

(30) Foreign Application Priority Data

Apr. 28, 2004 (CA) ..... 2465425

(51) Int. Cl.
*E21B 23/01* (2006.01)

(52) U.S. Cl. ..... 166/210; 166/382

(58) Field of Classification Search ..... 166/382, 166/208, 206, 117.7, 242.1, 210, 241.3, 241.6; 175/325.5

See application file for complete search history.

(56) References Cited

U.S. PATENT DOCUMENTS 3,352,370 A * 11/1967 Livingston ..... 175/73
3,799,279 A * 3/1974 Farris ..... 175/325.3
5,623,991 A 4/1997 Jani
5,778,976 A * 7/1998 Murray ..... 166/241.6
6,041,859 A 3/2000 Blades
6,073,693 A * 6/2000 Aldridge ..... 166/217
6,116,356 A * 9/2000 Doster et al. ..... 175/75
6,189,610 B1 2/2001 LaClare et al.
6,681,853 B2 * 1/2004 Doyle et al. ..... 166/214
6,892,811 B2 * 5/2005 LaClare et al. ..... 166/217
2002/0056574 A1 * 5/2002 Harvey et al. ..... 175/320

* cited by examiner

*Primary Examiner*—David Bagnell
*Assistant Examiner*—Daniel P Stephenson
(74) *Attorney, Agent, or Firm*—Ryan W. Dupuis; Michael R. Williams; Adrian D. Battison

(57) ABSTRACT

An anchoring tool anchors a tubing string within a surrounding well casing against rotation in either clockwise or counter clockwise directions. The tool includes a tubular housing for connection in line with the tubing string. A fixed jaw is fixedly mounted on the tubular housing and a floating jaw is supported for full rotation about the tubular housing past the fixed jaw. When the floating jaw engages the well casing, the overall diameter of the tool is varied as the fixed jaw is rotated with the tubing string relative to the floating jaw and the surrounding well casing. The tool can be used for anchoring the tubing string to the well casing in either direction while the tool remains down hole in the well casing due to the floating jaw being rotatable past the fixed jaw.

21 Claims, 5 Drawing Sheets

TUBING STRING ANCHORING TOOL

This application claims foreign priority benefits from Canadian Patent Application 2,465,425 filed Apr. 28, 2004.

FIELD OF THE INVENTION

This invention relates to an anchoring tool for anchoring a tubing string to a surrounding well casing.

BACKGROUND

Tubing strings are commonly used in oil production and generally comprise a plurality of threaded sections coupled together with an inline pump. Under certain conditions the pump can transmit large rotational forces to the tubing string which tends to release the threaded sections of the string. As this is undesirable anchors are commonly employed for preventing rotation of the tubing string in a direction corresponding to rotation of the rotor of the pump. In other situations however it may be desirable to manipulate the tubing string by preventing rotation of the tubing string in an opposite direction to the rotation of the pump. Anchoring of the tubing string may thus be desirable in both directions when it is desirable to set or unset various components coupled inline with the tubing string.

U.S. Pat. No. 5,623,991 to Jani provides a tubing tightener which is adaptable to anchor a tubing string against either clockwise or anti-clockwise rotation. The tubing tightener however requires a complex arrangement of drag slips which are operable for anchoring the tubing string in one direction only for any particular configuration of the slips. In use, the tubing tightener is thus only arranged for anchoring the tubing string in a single predetermined direction for which the tightener is configured.

U.S. Pat. No. 6,041,859 to Blades provides an anti-rotation device in which a gripping member is pivotally mounted on a housing of the device and includes a gripping surface which is arranged to engage the surrounding well casing for anchoring in one direction of rotation only. A spring is provided to bias the gripping surface into engagement with the well casing at all times.

U.S. Pat. No. 6,189,610 to LaClare et al discloses an anchoring tool in which two floating jaws rotate about a tubular housing supporting a fixed jaw thereon. The floating jaws cannot be rotated past the fixed jaw however, thus limiting the anchor tool to anchoring in only one direction of rotation once placed in a well casing.

SUMMARY

According to one aspect of the present invention there is provided an anchoring tool for anchoring a tubing string within a surrounding well casing, the anchoring tool comprising:

a tubular housing for connection in line with the tubing string;

a fixed jaw mounted on the tubular housing in fixed relation to the tubular housing for rotation with the tubular housing in relation to the surrounding well casing; and a floating jaw supported for full rotation about the tubular housing in relation to the fixed jaw for engaging the well casing to vary an overall diameter of the tool as the fixed jaw is displaced relative to the floating jaw.

The use of a floating jaw which is supported for full rotation about the tubular housing in relation to the fixed jaw permits the floating jaw to be rotated past the fixed jaw.

Accordingly the tool can be used for anchoring the tubing string to the well casing in either clockwise or counter-clockwise directions as desired while the tool remains down hole in the well casing.

The fixed jaw and the floating jaw are preferably supported sequentially in a longitudinal direction of the housing, abutted directly adjacent one another, one atop the other.

Preferably at least one end of the tubular housing is externally threaded for slidably receiving a floating collar onto the housing which supports the floating jaw rotatably about the housing. The opposing end may be internally threaded to define a shoulder about an outer side of the housing against which the floating jaw abuts.

The floating jaw may be abutted between confronting shoulders formed on the housing.

The floating jaw is preferably fixed on a collar rotatably supported about the housing with the collar extending a full length of the floating jaw in a longitudinal direction of the housing for fully supporting the jaw.

When one end of the housing is internally threaded so as to form an external annular shoulder, the floating jaw is preferably supported on a collar abutted between the internally threaded end of the housing and the fixed jaw.

Both the floating jaw and the fixed jaw may be selectively separable from the housing for interchanging the jaws with replacement jaws as desired.

The fixed jaw may be supported on the housing by shearable threaded fasteners. The floating jaw may be supported on the housing by the fixed jaw so that all jaws are releasable when the fasteners are sheared.

The floating jaw preferably projects radially outwardly from a longitudinal axis of the housing a radial distance which is greater than that of the fixed jaw by a distance of a fraction of an inch.

Each jaw preferably includes a strip of wear-resistant material, for example tungsten carbide, secured along an outwardly facing side thereof for gripping the well casing.

The wear-resistant material on one of the jaws may include a flat edge facing outwardly wherein the wear-resistant material on the other one of the jaws includes a sharp edge facing outwardly.

The flat edge is preferably located on the fixed jaw.

One end of the wear-resistant material of one of the jaws is preferably sloped at an incline.

There may be provided biasing means urging the floating jaw to an unset position in longitudinal alignment with the fixed jaw.

According to a second aspect of the present invention there is provided a method for anchoring a tubing string within a surrounding well casing, the method comprising:

providing an anchoring tool having a tubular housing, a fixed jaw fixedly mounted on the tubular housing and a floating jaw supported for full rotation about the tubular housing in relation to the fixed jaw;

connecting the tubular housing in line with the tubing string;

engaging the floating jaw against the well casing; and rotating the fixed jaw with the tubular housing in relation to the surrounding well casing to vary an overall diameter of the tool as the fixed jaw is displaced relative to the floating jaw from an unset position to a set position in which the overall diameter of the tool is greater than the unset position.

The method may include rotating the fixed jaw with the tubing string in a first direction in relation to the floating jaw to a first set position and subsequently rotating the fixed jaw with the tubing string in a second direction opposite to the first direction past the floating jaw to a second set position.

The method may further include selecting a distance which the jaws project radially from the tubular housing prior to connecting the housing in line with the tubing string such that the housing engages the well casing opposite the jaws which are between 45° and 135° apart in the set position of the tool.

BRIEF DESCRIPTION OF THE DRAWINGS

In the accompanying drawings, which illustrate exemplary embodiments of the present invention.

DETAILED DESCRIPTION

Figure 1:
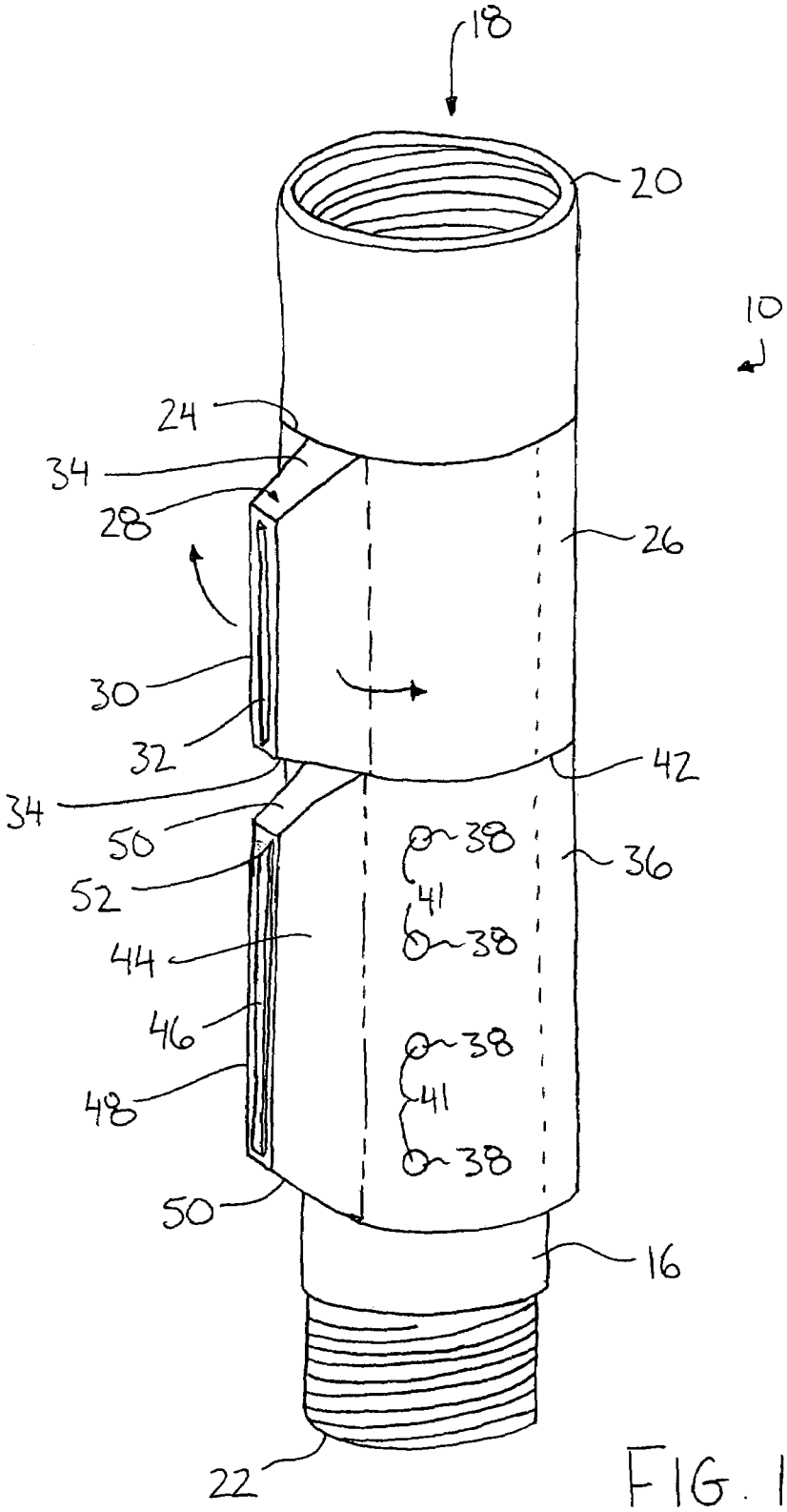
FIG. 1 is a perspective view of the anchoring tool.
Figure 2:
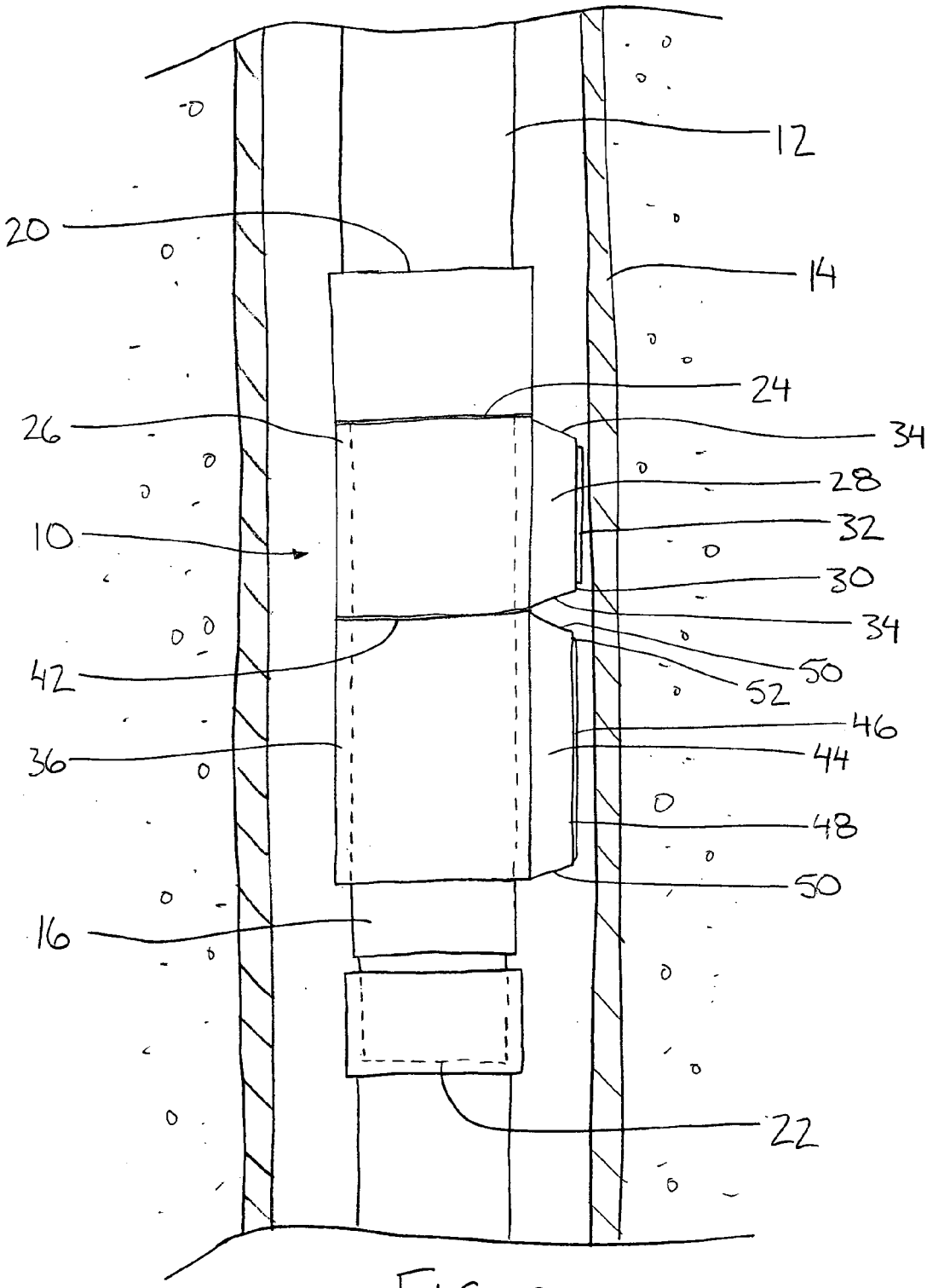
FIG. 2 is an elevational view of the tool supported on a tubing string in a well casing.
Figure 4:
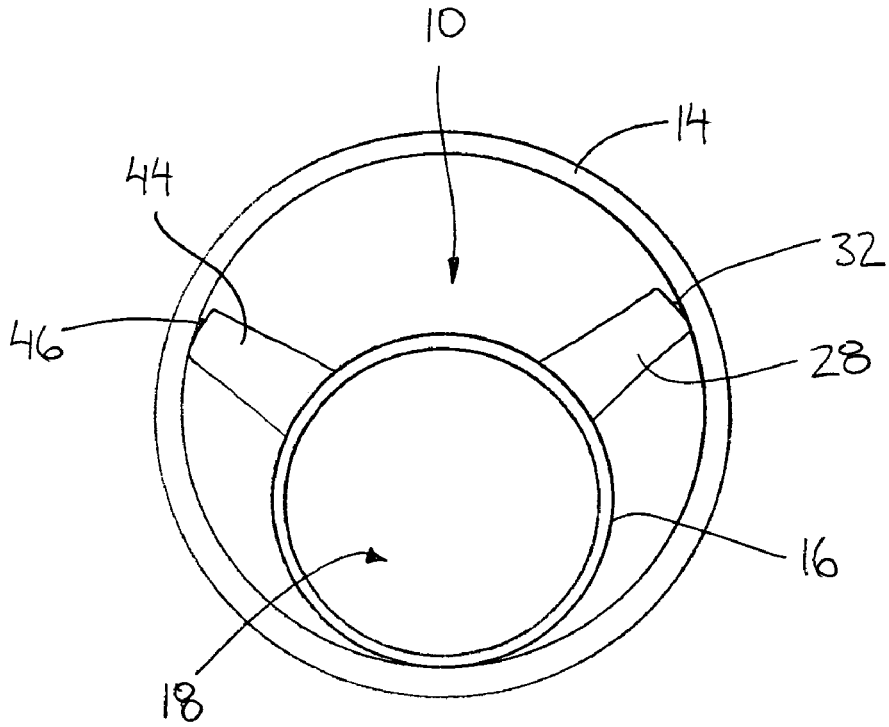
FIGS. 3 and 4 are sectional plan views of the tool in a well casing in the unset position and the set position respectively.
Figure 3:
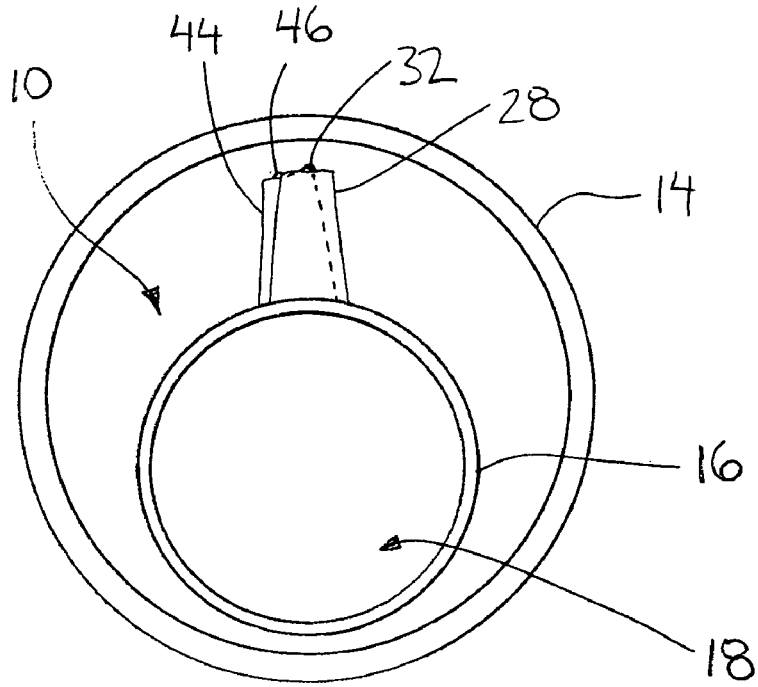
Figure 5:
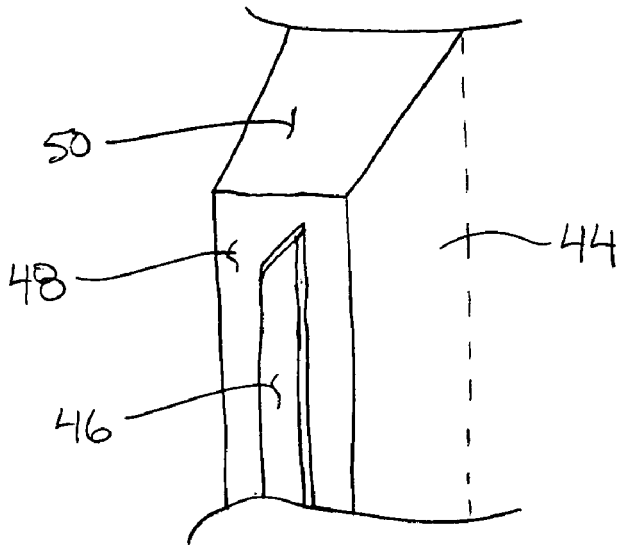
FIG. 5 is a perspective view of the fixed jaw.
Figure 6:
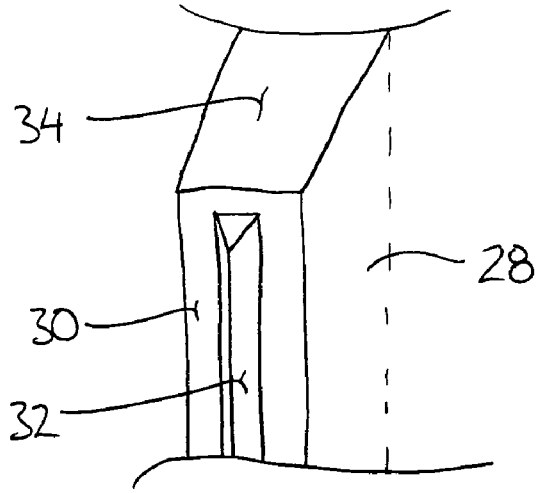
FIG. 6 is a perspective view of the floating jaw.
Figure 7:
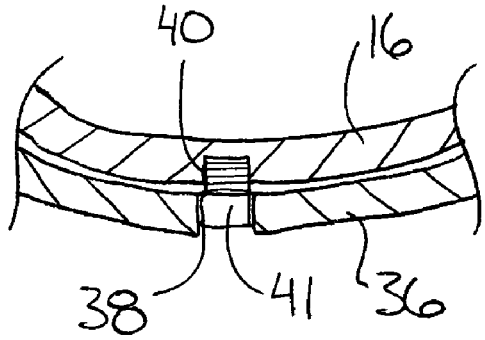
FIG. 7 is a sectional view of one of the shearable bolts securing the fixed jaw onto the housing.

Referring to the accompanying drawings there is illustrated an anchoring tool generally indicated by reference numeral 10. The tool is arranged for anchoring a tubing string 12 against rotation relative to a surrounding well casing 14 of the type commonly used in oil production. The anchoring tool 10 is arranged to anchor against relative rotation in either direction to resist rotation imposed by inline pumps of the tubing string or other rotations in other directions due to setting and unsetting operations of various components of the tubing string including down hole flow control valves and the like.

The tool 10 includes a tubular housing 16 which is cylindrical and elongate in a longitudinal direction of the housing. The housing includes a hollow through-passage 18 extending between an open top end 20 and an open bottom end 22 of the housing. The bottom end includes a stepped portion of reduced diameter which is externally threaded for threaded connection in series with the tubing string 12. The diameter of the external threads is smaller than the main body portion of the housing 16. The top end 20 of the housing includes a portion of increased diameter defining an annular shoulder 24 about the housing adjacent the top end forming an end face which is perpendicular to the longitudinal direction of the housing. The open top end is internally threaded for threaded connection in series with the tubing string.

A floating collar 26 is rotatably supported about the main body portion of the housing for abutment against the annular shoulder 24. The floating collar 26 includes an interior diameter which closely fits the outer diameter of the housing so that the collar can be slid onto the main body portion of the housing over the externally threaded bottom end 22. Once supported in place with an end face of the collar abutted against the shoulder 24, the floating collar 26 remains fully rotatable about the housing.

A floating jaw 28 is welded onto the collar for rotation therewith about the housing. The floating jaw 28 is an elongate member extending in the longitudinal direction alongside the housing and projecting radially outwardly from the floating collar 26. The floating jaw 28 and the collar 26 are substantially equal in length in the longitudinal direction so that the collar fully supports the jaw 28 along its full length.

An outer side 30 of the floating jaw facing radially outwardly includes a wear-resistant insert 32 embedded therein in the form of a strip of tungsten carbide. The strip is positioned so that an elongate corner edge of the insert projects outwardly for gripping the surrounding well casing 14. The end faces 34 of the floating jaw 28 which face in the longitudinal direction of the tubing string are each sloped inwardly towards one another as they extend radially outwardly from the floating collar 26 to minimize any snagging as the tool is inserted and removed from the well casing.

A fixed collar 36 is received about the housing 16 between the floating collar 26 and the externally threaded bottom end 22 of the housing. The fixed collar similarly includes an interior diameter which is close in fit to the outer diameter of the housing for snugly and slidably being received over the bottom end of the housing into a mounted position on the main body portion of the housing.

Bolt holes 38 are formed in the fixed collar 36 at longitudinally spaced positions thereon for alignment with threaded bores 40 in the main body of the housing 16. The bores 40 are not through-bores and accordingly do not communicate with the interior through-passage 18 of the housing but instead receive bolts secured therein from an outer side to fix the fixed collar 36 in place in relation to the housing so that the fixed collar is prevented from movement in a longitudinal direction or rotatably about the housing.

The bolts 41 comprise shearable studs which permit both the fixed collar and the floating collar, along with the respective jaws supported therein, to be slidably removed from the housing when sheared. If the housing were ever jammed within the well casing, lifting the tubing string with sufficient force to shear the bolts 41 would thus cause the collars and jaws supported thereon to be released.

In its mounted position, an end face of the fixed collar 36 facing the floating collar 26 is a flat annular surface defining an annular shoulder 42 for abutment against a flat end face of the floating collar 26. In this configuration the floating collar remains freely rotatable about the housing but is restricted from any sliding movement in the longitudinal direction of the housing by being abutted between the shoulder 24 at the open top end 20 of the housing and the shoulder 42 of the fixed collar 36 confronting the shoulder 24.

A fixed jaw 44 is welded onto the fixed collar in fixed relation therewith and in fixed relation to the housing when the fixed collar is in its mounted position bolted in place. The fixed jaw 44 is an elongate member extending in the longitudinal direction alongside the housing and projecting radially outwardly from the fixed collar upon which is supported. The fixed jaw 44 extends a full length of the fixed collar such that the jaws 28 and 44 are positioned directly adjacent one another one atop the other in the longitudinal direction of the housing but with the floating jaw remaining freely rotatable about the housing so that the floating jaw is rotatable past the fixed jaw.

A wear-resistant insert 46 is similarly embedded in the outer side 48 of the fixed jaw 44 which faces radially outwardly. The fixed jaw also includes sloped end faces 50 spanning between the fixed collar and the outer side 48 of the fixed jaw and which face outwardly in the longitudinal direction of the tubing string. The end faces 50 are sloped inwardly towards one another as they project outwardly in the radial direction to similarly prevent any snagging against the well casing as the tubing string is displaced upwardly or downwardly in the casing. The insert 46 is arranged such that a flat edge thereof faces outwardly. A top edge 52 of the insert which faces upwardly in the longitudinal direction of the tool, is sloped at an incline in relation to a horizontal plane perpendicular to the longitudinal direction. When the insert 46 of the fixed jaw is engaged with the well casing, upward movement on the tubing string relative to the casing would cause the housing to twist and rotate relative to the casing as the top edge 52 of the insert acts as a screw thread for releasing the tool if wedged in a set position.

The floating jaw is arranged to project radially outwardly a distance which is slightly greater than the fixed jaw relative to the longitudinal axis of the housing. The edge of the carbide insert 32 in the floating jaw is spaced radially outwardly in the order of 200/1000th of an inch in relation to the insert 46 of the fixed jaw for gripping the well casing first as the tubing string is rotated relative to the well casing.

The tool is operated to anchor a tubing string against rotation relative to a surround well casing in one direction of rotation for each set position of the tool. The tool is first threadably connected in series with a tubing string. When it is desired to anchor rotation of the tubing string in a first direction, the tubing string is rotated first in that direction until the floating jaw which is slightly greater in diameter grips the well casing and remains engaged with the well casing as the fixed jaw continues to rotate with the tubular housing. The overall diameter of the tool begins to increase as the jaws distance themselves from one another. As the jaws are spread apart, in the order of 45° to 135° apart, the tubular housing and associated tubing string are pressed up against the well casing opposite the spaced apart jaws.

The radial distance that the jaws project is selected so that the jaws cannot be rotated 180° apart within the well casing as the overall diameter of the tool when the jaws are diametrically opposed from one another exceeds the internal diameter of the well casing. Before inserting the tool into the well casing, the fixed collar can be readily removed by replacing the bolts so that both the fixed and floating collars with the jaws supported thereon are readily removed from the housing. Replacement collars and associated jaws having varying radial dimensions can be provided and reassembled onto the housing to suite a particular well casing internal diameter.

If it is desired to anchor rotation of the tubing string subsequently in a second direction opposite to the first direction, the tubing string is simply rotated in the second direction until the fixed collar is rotated past the floating jaw with the tubing string after which point the floating jaw, having been released from the well casing, then re-engages the well casing upon continued rotation of the tubing string. Continued rotation in the second direction causes the jaws to again spread apart in the opposite direction until a second set position is achieved with the housing pressed up against the side wall of the well casing opposite the spaced apart jaws engaged with the casing as well.

By supporting the tubular housing and associated tubing string against one side of the well casing in the set position, considerable clearance is provided between the spaced apart jaws and between the housing and the well casing opposite the point of engagement with the tubing string and the well casing. The clearance is sufficient for a coil tubing unit to be readily inserted down through the well casing past the anchoring tool to free up sanding as required.

Figure 8:
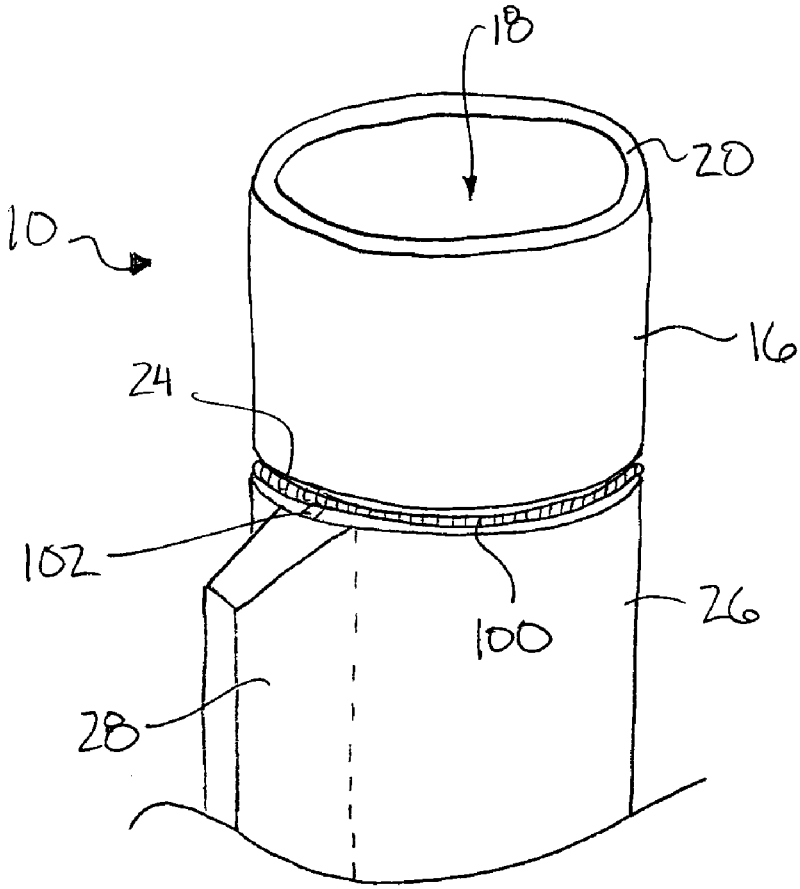
FIG. 8 is a perspective view of a further embodiment of the tool.

In a further embodiment, as illustrated in FIG. 8, there may be provided a spring member 100 for biasing or urging the floating jaw to an unset position in longitudinal and vertical alignment with the fixed jaw. In this instance, an annular gap is formed between the shoulder 24 of the housing and the annular end face of the floating collar 26 within which the spring member 100 is received. The spring member 100 is an annular spring or annular member of resilient material secured to the floating collar 26 at a mounting location 102 near the jaw. The spring member 100 is also anchored to the housing diametrically opposite the fixed and floating jaws in the unset position and accordingly diametrically opposite the mounting location 102. When the tubing string is rotated to rotate the jaws out of the set position, the spring member urges the floating jaw into alignment with the fixed jaw for ease of insertion or removal of the tool from the well casing.

In further embodiments, the bolts 41 may instead be threaded to the floating collar and are merely aligned with the bores 40 in the housing at a stud portion of the bolt rather than being threaded therein. Accordingly if the bolts are sheared, the heads of the bolts can threadably be removed from the floating collar using the original sockets formed in the end thereof. The remaining stud portions located in the bores 40 in the housing can be simply pulled out and do not require unthreading in this instance.

While some embodiments of the present invention have been described in the foregoing, it is to be understood that other embodiments are possible within the scope of the invention. The invention is to be considered limited solely by the scope of the appended Claims.

The invention claimed is:

1. An anchoring tool in combination with a well casing for anchoring a tubing string within the well casing, the anchoring tool comprising:

a tubular housing arranged for connection in line with the tubing string;

a fixed jaw mounted on the tubular housing in fixed relation to the tubular housing and arranged for rotation with the tubular housing in relation to the surrounding well casing; and a floating jaw supported for full rotation about the tubular housing in relation to the fixed jaw and arranged for engaging the well casing to vary an overall diameter of the tool as the fixed jaw is displaced relative to the floating jaws;

the overall diameter of the tool being arranged to be greater than a diameter of the well casing when the fixed jaw and the floating jaw are diametrically opposite one another;

the floating jaw being rotatable away from the fixed jaw from an unset position to a set position in which the floating jaw and the fixed jaw are farther apart from one another in the set position than in the unset position and in which the overall diameter of the tool is increased in the set position relative to the unset position; and the tubular housing being arranged to engage the well casing opposite the fixed jaw and the floating jaw engaging the well casing in the set position.

2. The tool according to claim 1 wherein the fixed jaw and the floating jaw are supported sequentially in a longitudinal direction of the housing.

3. The tool according to claim 1 wherein the fixed jaw and the floating jaw are abutted directly adjacent one another.

4. The tool according to claim 1 wherein the floating jaw is abutted between confronting shoulders formed on the housing.

5. The tool according to claim 1 wherein the floating jaw is fixed on a collar rotatably supported about the housing, the collar extending a full length of the floating jaw in a longitudinal direction of the housing.

6. The tool according to claim 1 wherein one end of the housing is internally threaded and wherein the floating jaw is supported between the internally threaded end of the housing and the fixed jaw.

7. The tool according to claim 1 wherein both the floating jaw and the fixed jaw are selectively separable from the housing.

8. The tool according to claim 1 wherein the fixed jaw is supported on the housing by shearable threaded fasteners.

9. The tool according to claim 1 wherein the floating jaw projects radially outwardly from a longitudinal axis of the housing a radial distance which is greater than that of the fixed jaw.

10. The tool according to claim 9 wherein the floating jaw extends radially outward beyond the fixed jaw a distance of a fraction of an inch.

11. The tool according to claim 1 wherein each jaw includes a strip of wear-resistant material secured along an outwardly facing side thereof.

12. The tool according to claim 11 wherein the wear-resistant material on one of the jaws includes a flat edge facing outwardly and wherein the wear-resistant material on the other one of the jaws includes a sharp edge facing outwardly.

13. The tool according to claim 12 wherein the flat edge is located on the fixed jaw.

14. The tool according to claim 11 wherein one end of the wear-resistant material facing in a longitudinal direction of the housing on one of the jaws is sloped at an incline.

15. The tool according to claim 1 wherein there is provided biasing means urging the floating jaw to the unset position in longitudinal alignment with the fixed jaw.

16. A method for anchoring a tubing string within a surrounding well casing, the method comprising:

providing an anchoring tool having a tubular housing, a fixed jaw fixedly mounted on the tubular housing and a floating jaw supported for full rotation about the tubular housing in relation to the fixed jaw;

connecting the tubular housing in line with the tubing string;

engaging the floating jaw against the well casing; and rotating the fixed jaw with the tubular housing in relation to the surrounding well casing to vary an overall diameter of the tool as the fixed jaw is displaced relative to the floating jaw from an unset position to a set position in which the overall diameter of the tool is greater than the unset position.

17. The method according to claim 16 including rotating the fixed jaw with the tubing string in a first direction in relation to the floating jaw to a first set position and subsequently rotating the fixed jaw with the tubing string in a second direction opposite to the first direction past the floating jaw to a second set position.

18. The method according to claim 17 including arranging the jaws to project radially from the tubular housing prior to connecting the housing in line with the tubing string such that the housing engages the well casing opposite the jaws which are between 45° and 135 apart in the set position of the tool.

19. The method according to claim 16 including arranging the jaws to project radially from the tubular housing prior to connecting the housing in line with the tubing string such that the housing engages the well casing opposite the jaws which are between 45° and 135° apart in the set position of the tool.

20. The method according to claim 16 including arranging the jaws to project a radial distance from the tubular housing such that the overall diameter of the tool is greater than a diameter of the well casing when the jaws are diametrically opposite one another.

21. An anchoring tool in combination with a well casing for anchoring a tubing string within the well casing, the anchoring tool comprising:

a tubular housing arranged for connection in line with the tubing string:

a fixed jaw mounted on the tubular housing in fixed relation to the tubular housing and arranged for rotation with the tubular housing in relation to the surrounding well casing; and a floating jaw supported for full rotation about the tubular housing in relation to the fixed jaw and arranged for engaging the well casing to vary an overall diameter of the tool as the fixed jaw is displaced relative to the floating jaw;

the floating jaw being rotatable relative to the fixed jaw in a first direction less than 180 degrees from an unset position in which the floating jaw and the fixed jaw are aligned with one another to a first set position in which the fixed jaw and the floating jaw are arranged to engage the well casing such that the tubular housing is anchored against rotation relative to the well casing; and the floating jaw being rotatable relative to the fixed jaw in a second direction opposite the first direction less than 180 degrees from the unset position to a second set position in which the fixed jaw and the floating jaw are arranged to engage the well casing such that the tubular housing is anchored against rotation relative to the well casing.

* * * * *